US005860177A

United States Patent [19]

Jung

[11] Patent Number: 5,860,177

[45] Date of Patent: Jan. 19, 1999

[54] ADJUSTABLE TRAVEL PILLOW

[76] Inventor: Brian H. Jung, 7406 Colshire Dr. Apt. #1, McLain, Va. 22102

[21] Appl. No.: 837,700

[22] Filed: Apr. 22, 1997

[51] Int. Cl.[6] ..... A47C 20/02

[52] U.S. Cl. ..... 5/636; 5/637; 5/630

[58] Field of Search ..... 5/636, 622, 630; 297/391, 394, 396, 397, 400, 410; 248/297.21, 419, 118, 231.41; 224/275

[56] References Cited

U.S. PATENT DOCUMENTS

| | | | |
|---|---|---|---|
| D. 390,405 | 2/1998 | Jung | D6/601 |
| 3,586,366 | 6/1971 | Patrick | 297/410 |
| 3,979,150 | 9/1976 | Elzenbeck | 297/410 |
| 4,647,108 | 3/1987 | Hayashi | 297/391 |
| 4,840,429 | 6/1989 | Stockl | 297/391 |
| 5,165,137 | 11/1992 | Amrein et al. | 5/640 |
| 5,346,277 | 9/1994 | Holobaugh et al. | 297/396 |

*Primary Examiner*—Brian K. Green
*Assistant Examiner*—Fredrick Conley
*Attorney, Agent, or Firm*—Corbin Gittes & Samuel

[57] ABSTRACT

An adjustable travel pillow unit having a pillow outer shell, a support frame within the shell and an adjustment mechanism. The mechanism allows an arm to extend or retract in alignment with a plane and is movable itself in alignment with a plane perpendicular to the first mentioned plane.

7 Claims, 6 Drawing Sheets

31
18
30
56

31
29

30
28
29
27

31
18
27

ADJUSTABLE TRAVEL PILLOW

BACKGROUND OF THE INVENTION

1. Field of the Invention

The present invention relates to a travel pillow that is adjustable with respect to its relative position on the back support of a seat of a vehicle.

2. Discussion of Related Art

On mass transit mediums, such as the planes and the trains, the personal spaces for the passengers are often limited. The passengers are restricted from fully reclining their seats in order to fully lean their heads in a fixed position. Passengers on a long journey often find it difficult to find a restful position for their heads. Some methods, such as compacting several pillows against the window of the vehicle often provides little comfort because the head is leaning in an uncomfortable angle, resulting in a neck pain. And the passengers not seated on the windows don't even have that relief. When the reclining angle of the seat is restricted by the limited space, the seat will remain more in the upright, fall deeper into asleep, inadvertently their heads tend to fall to their sides thus acquiring a stiff neck or lean against their neighbor.

It would be desirable to attach the travel pillow onto a seat in a matter of seconds and position the pillow relatively high or low along the seat back support to accommodate any height of the user. Preferably, the travel pillow may be readily positioned straight up and down or in various tilted angles to lean the head even where the seat back support is substantially in a vertical position. Such flexibility in positioning preferably arises by attaching the travel pillow transverse to the back support of the seat.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
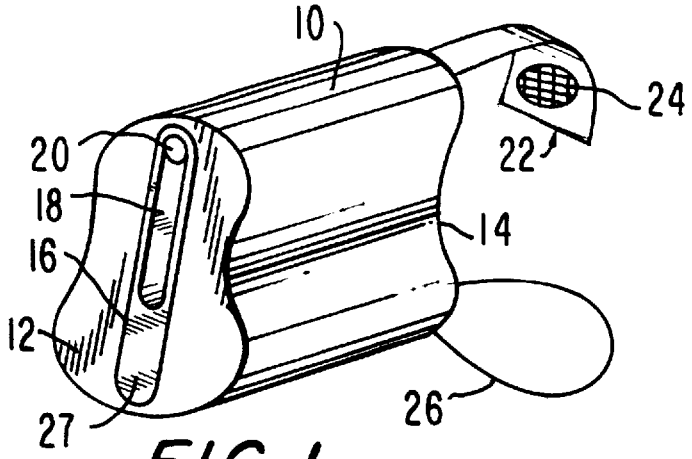
FIG. 1 is a perspective view of the adjustable travel pillow in accordance with the invention.

Turning to FIG. 1, the adjustable travel pillow unit includes a pillow outer shell 10, which is made of soft, cushion, foam material, such as the paddings used on weight lifting equipment. The material needs to be comfortable enough to use as a pillow but still hold its structural integrity. The pillow outer shell 10 has opposite ends 12, 14. Within the shell 10 is a frame 25 that has a lock nut 20 in a channel 18 accessible via a slit 16 in the pillow outer shell at one end 12.

The frame 25 is made of hard plastic, metal, wood or other sturdy material. One of the main functions of the frame 25 is to allow an outer cylinder 34 of a back supporting arm 22 (see FIG. 2) and the adjustment mechanism 35 (see FIG. 2) slide up and down.

The adjustment mechanism 35 locks the back supporting arm 22 in place when not in use, allows the user to release the arm 22 to extend for use, and allows adjustment of the height and the angle of the pillow.

Figure 2:
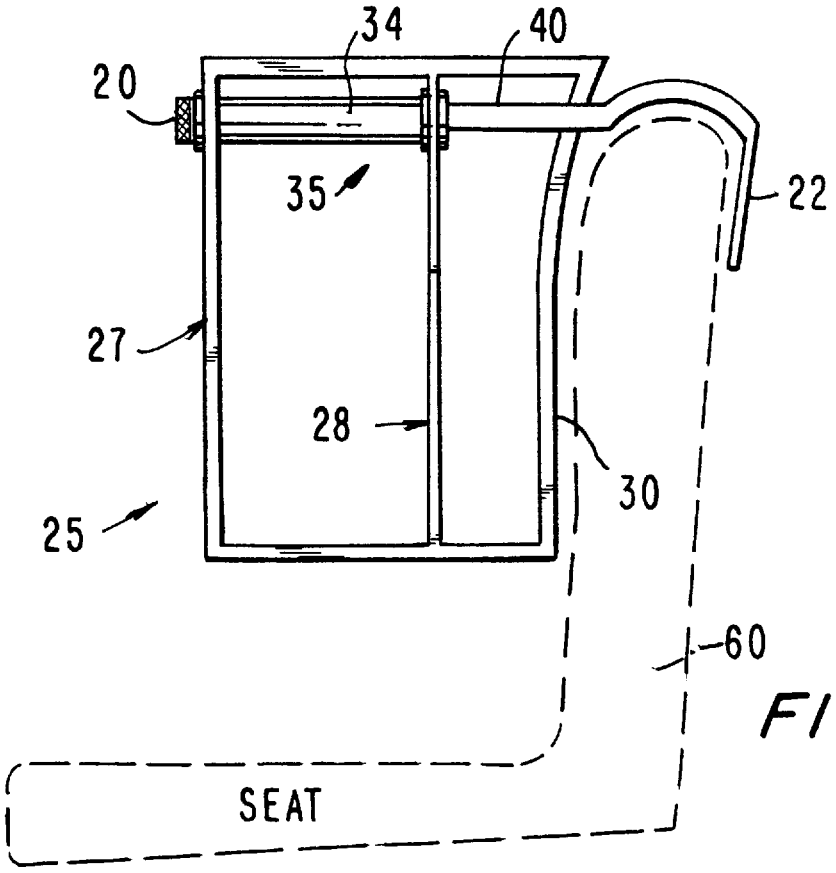
FIG. 2 shows an elevational view of a frame with an adjustment mechanism installed in accordance with the invention.

Referring to FIG. 2, the channel 18 is cut in the side of the outer brace 27 and the middle brace 28. The channel 18 permits the adjustment mechanism 35 to slide vertically for effecting height adjustment along the seat go back support. Inner brace 30 leans against the front of the seat back support via the opposite end 14 to stabilize the pillow along with front support extension 26.

Figure 4:
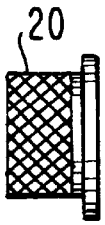
FIG. 4 shows a side view of a lock nut to close an end of the outer cylinder of FIG. 3.
Figure 3:
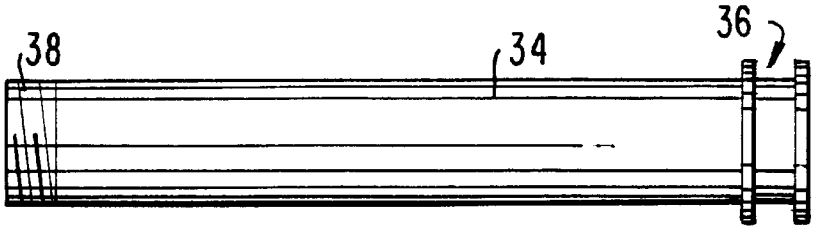
FIG. 3 shows a longitudinal side view of an outer cylinder of the adjustment mechanism of FIG. 1.

FIG. 3 shows the outer cylinder 34 of the adjustment mechanism 35. This outer cylinder 34 houses the back support shaft 40 and the release pin assembly. The angle adjustment lock nut 20 (FIG. 4) screws onto the outer cylinder 34. The recess 36 on the outer cylinder 34 may frictionally grasp the outer cylinder 34 to stay in position along the brace 28 (FIG. 2) at any vertical position. Additionally, the lock nut 20 itself also acts to support the outer cylinder 34 in place as it is screwed against the brace 27.

Figure 5:
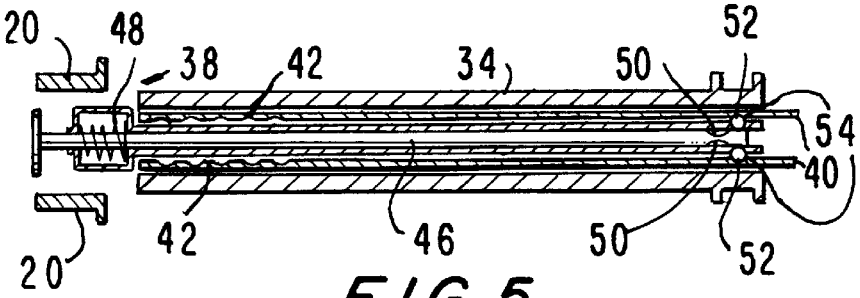
FIG 5 shows a cutaway view of a back support shaft and release pin assembly within the outer cylinder and lock nut of FIGS. 3 and 4.

FIG. 5 shows the cut away view of the back support shaft and the release pin assembly. The adjustment mechanism 35 provides for the retraction and the extension of the back support shaft 40. In the normal, closed position, the inner pin 46 of the assembly is pushed out by the spring bias of a spring 48. The bias forces the steel locking balls 52 into the grooves 54 in the back support shaft 40, thus locking the shaft 40 in place. When the inner pin 46 is pushed, the groove 50 in the pin 46, aligned with steel locking balls 52, allows the back support shaft 40 to slide and extend. The grooves 42 are spaced in intervals to allow for locking in different positions (such as for the different thickness of the seats).

Figure 6:
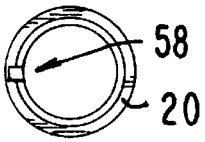
FIG. 6 shows an end view of an angle adjustment lock nut and alignment key.

FIG. 6 shows the outer cylinder 34 and the alignment key 58. The back support shaft 40 is the component, when the pillow is in use, that will be the anchor to hold the whole unit stationary and in place. The alignment key 58 on the shaft 40 physically keeps the shaft from rotating within the outer cylinder 34. The alignment key 58 mates the outer cylinder 34 with the back support shaft 40 in order to stabilize the outer cylinder with the pin 46. Otherwise, the outer shaft would turn and the back support would move. The alignment key provides the support necessary since the pin 46 moves freely in the shaft.

On the other hand, the outer cylinder 34 sliding up and down the frame is not stationary. It travels up and down and rotates. The lock nut 20 is utilized to secure the pillow outer shell 10 in one position once the desired height and the angle is obtained by sliding the pillow outer shell 10 up and down and tilting the pillow outer shell. The lock nut 20 is screwed onto the thread 38 on the outer cylinder 34, locking the nut 20 against the frame brace 27 (see FIG. 1), thus holding the pillow outer shell 10 in place.

Figure 7:
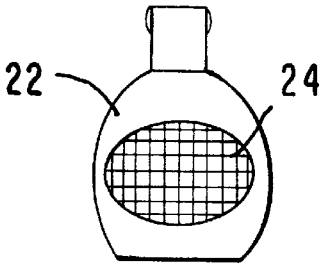
FIGS. 7 and 8 show end views of non-slip surfaces on seat back support securing components.
Figure 8:
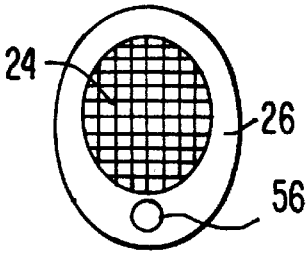

FIGS. 7 and 8 show the two pads that keep the pillow in position and stationary. These spoon shaped non-slip pads 24, each on a respective one of the back supporting arm 22 and the front support extension 26, are used to resist slippage on the fabric or plastic portions of the seat. The front support extension 26 also acts as an additional "leg" to hold the unit in place as the head is leaned against the pillow. It is pivotally connected to the inner brace 30.

To operate, the lock nut 20 is loosened to free the adjustment mechanism to slide vertically within the channel 18. When a desired relative vertical position is attained, the lock nut 20 is tightened to keep the adjustment mechanism 35 stationary in position. To move the back support shaft 40 to the desired position, the inner pin 46 is pushed against spring bias by pulling out the back supporting arm 22 until the appropriate of the grooves 42 lock with the steel locking balls 52. To close, the back supporting arm 22 is pushed in so that the inner pin 46 is allowed under spring bias to reach a relative position in which the steel locking balls 52 and the grooves 54 align. Note that grooves 42 and grooves 54 are spaced apart, each close to its own associated end of the outer cylinder 34.

The adjustment mechanism 35 slides in the channel 18 in alignment with a first plane. The back supporting arm 22 moves back and forth as desired to clamp onto the seat by moving in alignment with a plane perpendicular to the plane through which the adjustment mechanism 35 moves in the channel 18.

To close, the front support extension 26 is swung about its pivot 56 adjacent the end 14 of the pillow outer shell. The back support arm 22 is pushed adjacent this end 14 as well. As necessary, the lock nut 20 may be released to permit the adjustment mechanism to slide to an end position so as to help position the back support arm 22 so it does not interfere with the front support extension 26.

Figure 9:
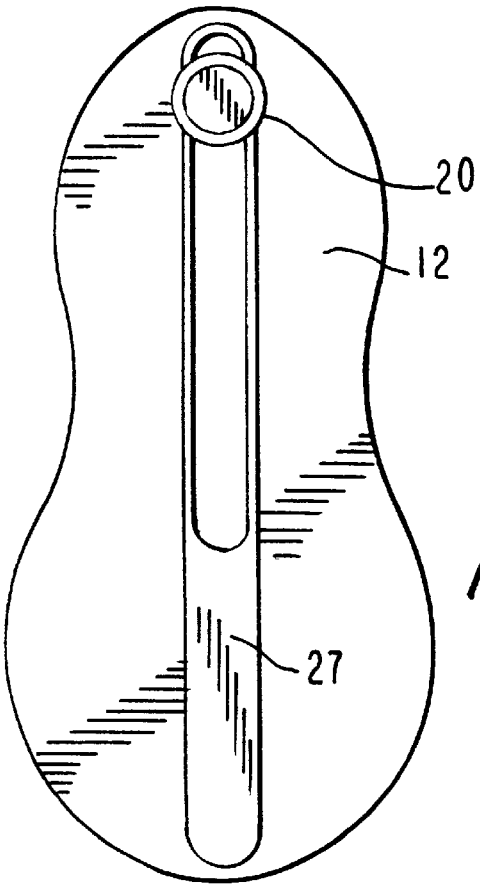
FIG. 9 shows a front end view of the adjustable travel pillow as seen in the perspective view of FIG. 1.
Figure 10:
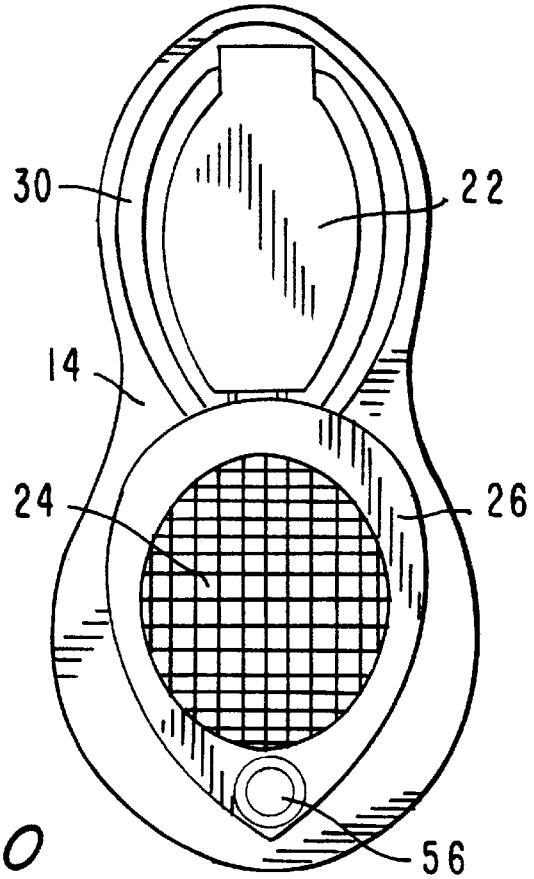
FIG. 10 shows a rear end view of the adjustable travel pillow.

FIGS. 9 and 10 show opposite end views 12, 14 of the pillow, with the adjustment mechanism in a closed, storage position. The lock nut 20, outer brace 21, inner brace 30, back supporting arm 22, non-slip surface 24 and front support extension 26 are identified in the drawings.

Figure 12:
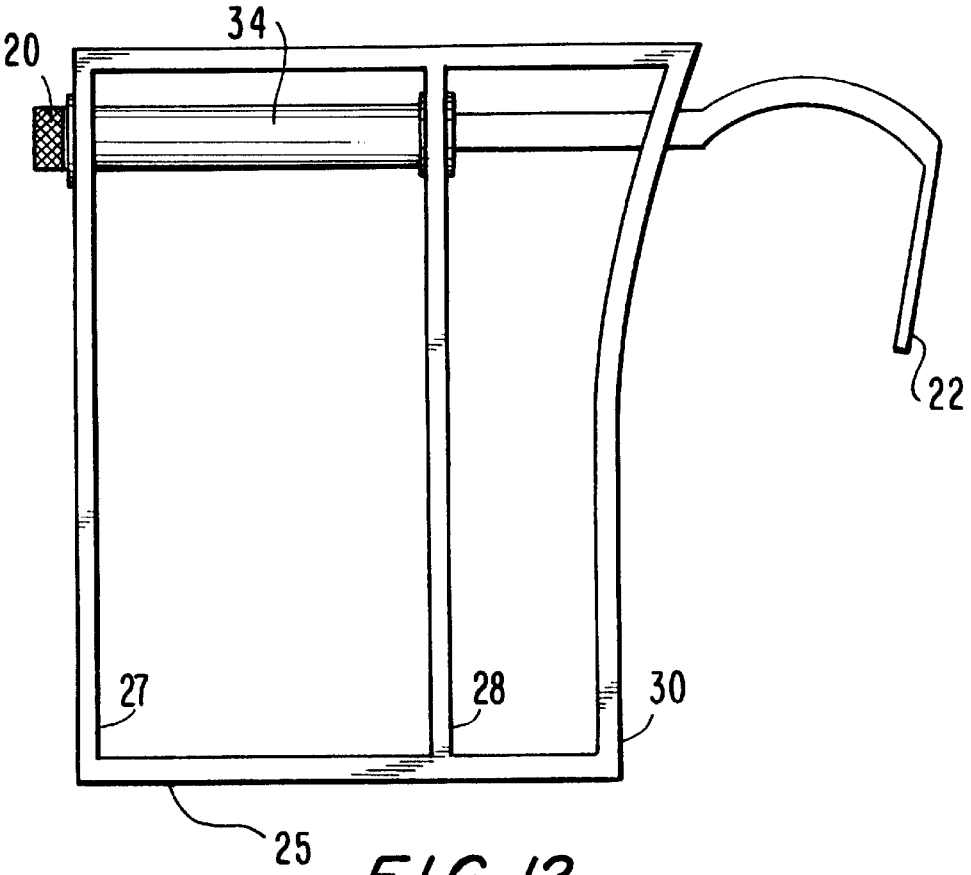
FIGS. 11 and 12 are progressive side elevation views showing the back supporting arm in, respectively, retracted extended positions.
Figure 11:
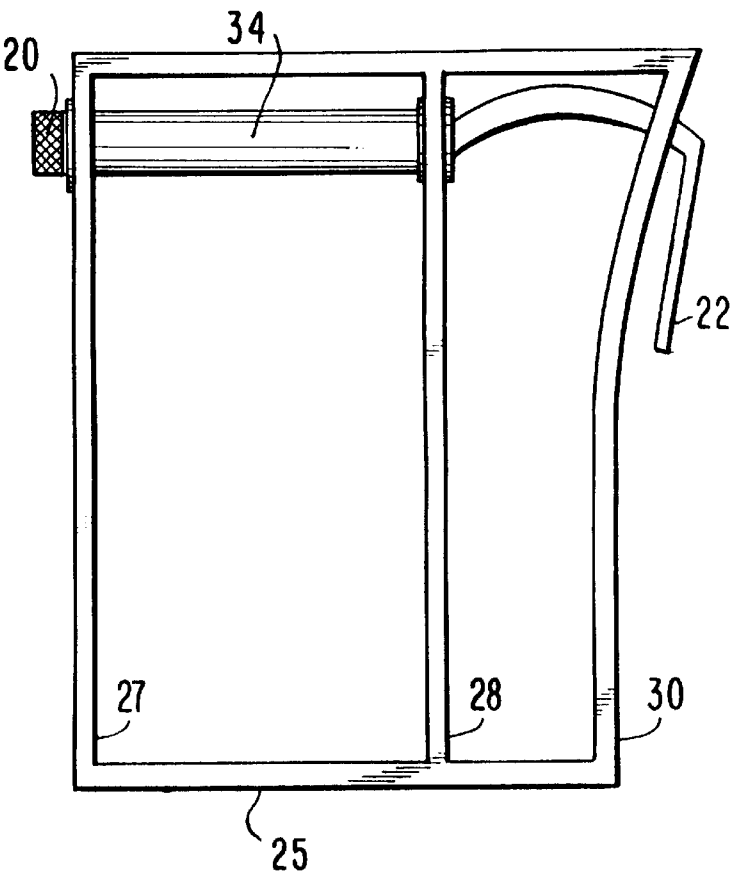
Figure 14:
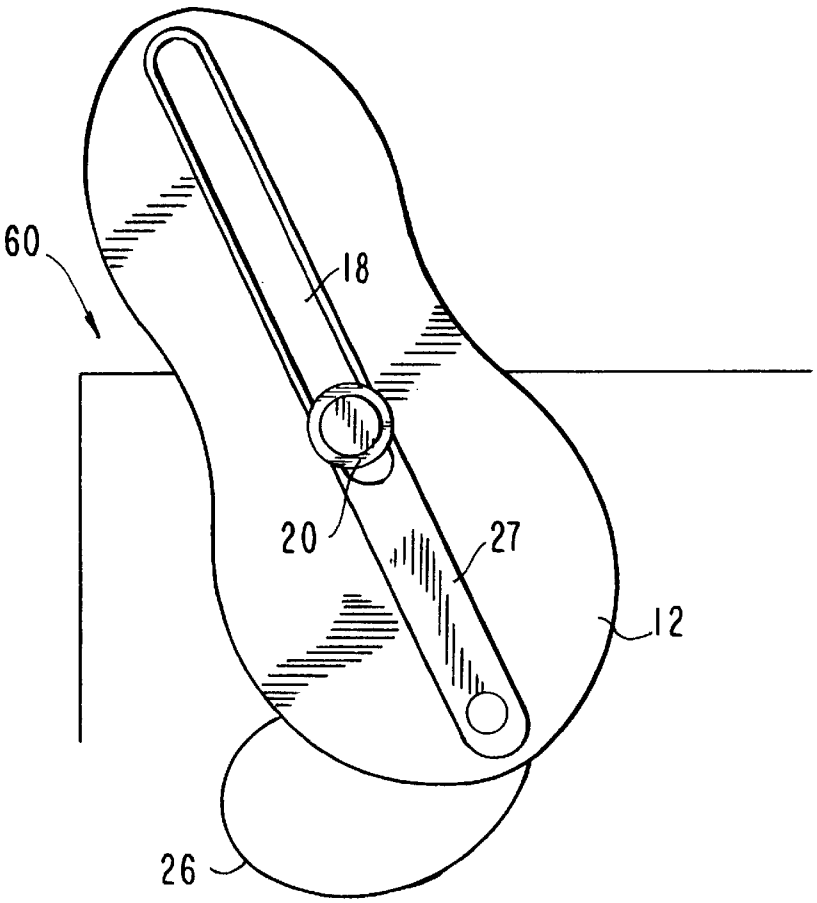
FIGS. 13 and 14 show progressive views of the adjustable travel pillow of FIG. 1, respectively, in lower and high positions with respect to a seat.
Figure 13:
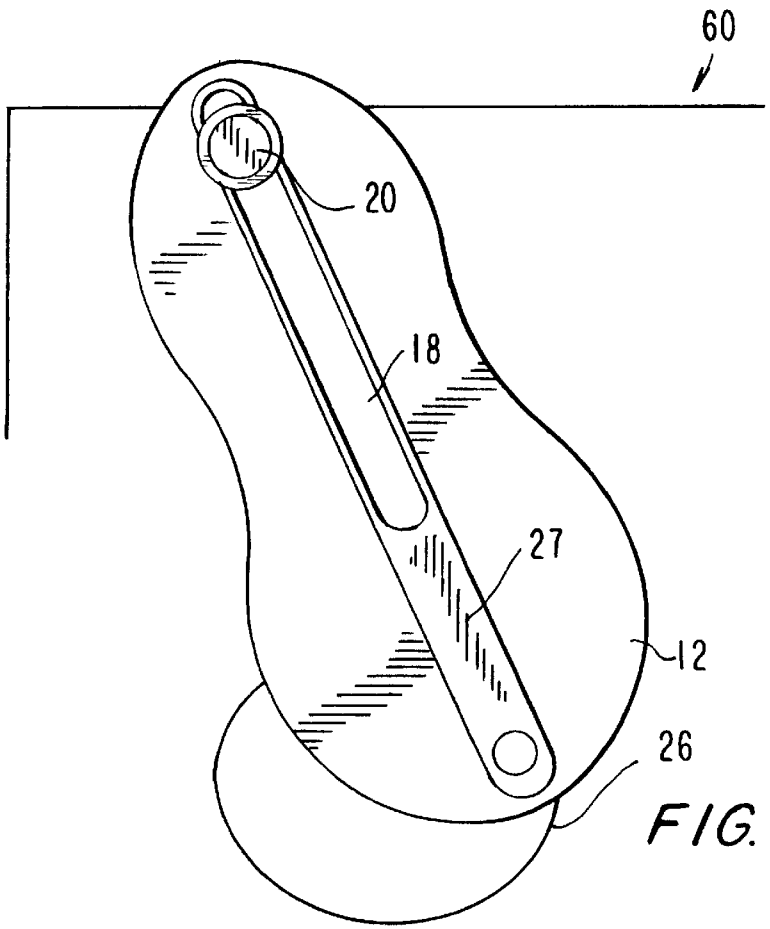
Figures 15, 16, 17, 18:
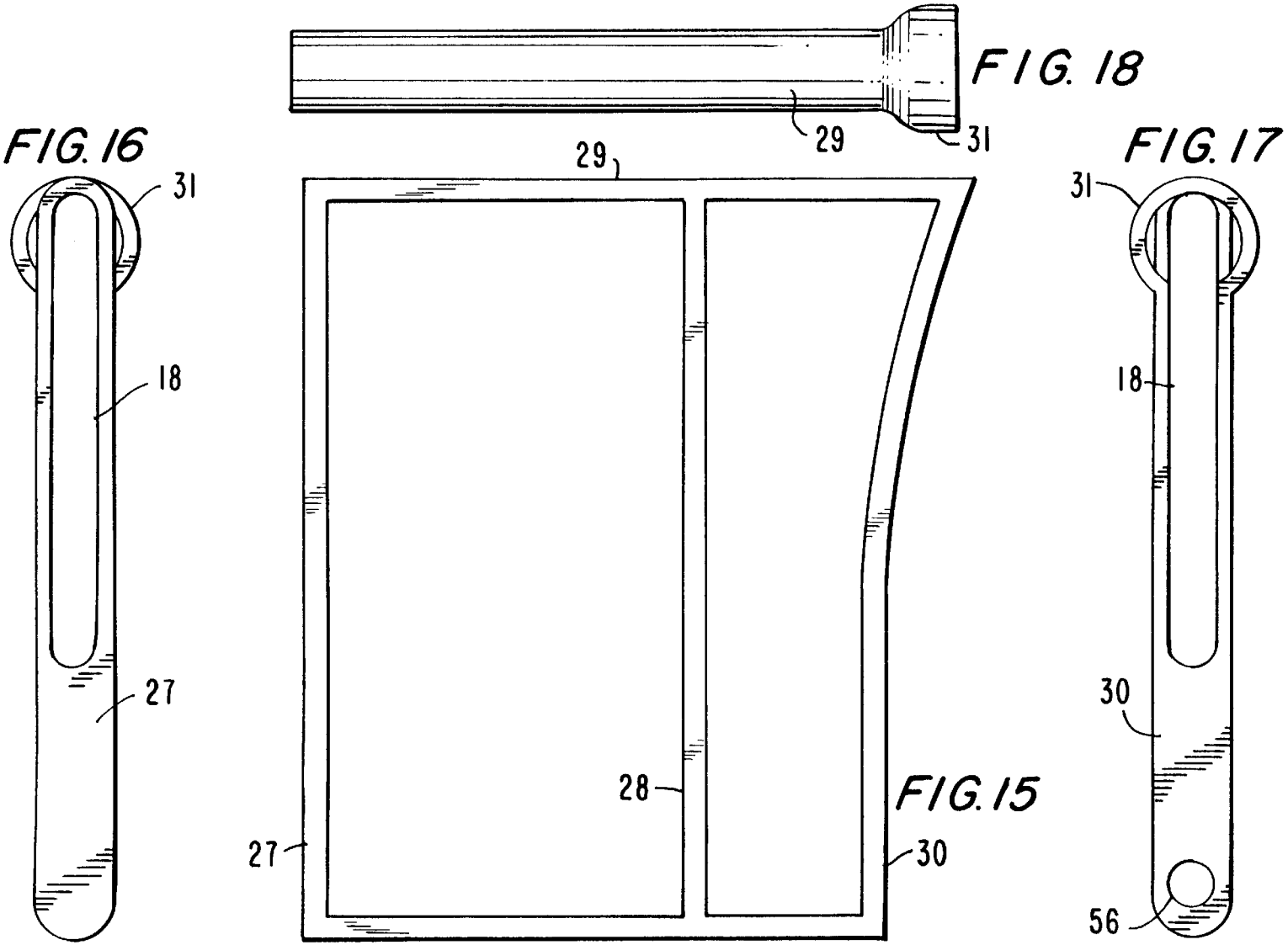
FIGS. 15–18 are side elevational, front, rear and top views of the frame of FIG. 2.

FIGS. 11 and 12 show the back support arm 22 in retracted (for compact storage) and in extended (for seat securement) positions. The push button 46 allows the steel ball 52 to slide into a groove 50. This releases the back support shaft 40 so that it can extend. Adjustment can be made to a number of grooves 42 for an exact fit. FIGS. 13 and 14 show the seat adjusted to either a relatively low position or a relatively high position with respect to the elevation of the back of the seat 60. Loosen locknut 20 which releases the friction between the locknut and the frame 27. This permits up and down movement and swing angle.

FIGS. 15–18 show the frame with its braces 27, 28, 30 and a top brace 29. One end slide 31 of the top brace 19 widens diametrically to become flat (FIG. 17) to form a substantially circular end portion so as to form fit to the top of the seat 60.

While the foregoing description and drawings represent the preferred embodiments of the present invention, it will be understood that various changes and modifications may be made without departing from the spirit and scope of the present invention.

What is claimed is:

1. An adjustable travel pillow unit, comprising:

an outer shell whose outer surface is cushioned;

a frame having a channel, said frame being within confines of said outer shell; and an adjustment mechanism that includes an arm holder and includes an arm movable in a linear direction between retracted and extended positions with respect to both said arm holder and said frame, said arm holder being arranged to guide along said channel so that said arm holder and said frame are movable relative to each other in a direction that is transverse to said linear direction.

2. A unit as in claim 1, further comprising a slip resistant surface on said arm.

3. A unit as in claim 2, further comprising an extension pivotally connected to said frame; and a further slip resistant surface on said extension and facing in a direction opposite to that of said slip resistant surface on said arm.

4. A unit as in claim 1, wherein said arm holder is an outer cylinder, further comprising a release pin assembly operatively moving said arm between said retracted and extended positions in response to corresponding actuation, said outer cylinder having a recess engaging said frame to allow movement through said channel, said release pin assembly being within said outer cylinder.

5. A unit as in claim 4, wherein said release pin assembly includes spaced apart grooves and balls engageable with each of said grooves, said grooves being on said arm.

6. A unit as in claim 5, further comprising a lock nut secured to said outer cylinder that, when tightened to said frame, prevents said adjustment mechanism from moving in said channel, and when loosened on said frame, permits said adjustment mechanism to move in said channel.

7. A unit as in claim 6, further comprising an alignment key on said arm that prevents rotation relative to said outer cylinder.

* * * * *